US005131802A

United States Patent [19]

Sunami et al.

[11] Patent Number: 5,131,802

[45] Date of Patent: Jul. 21, 1992

[54] VEHICLE EQUIPPED WITH BALANCING DEVICE

[75] Inventors: Tsuneo Sunami, Ryugasaki; Hiroo Namerikawa, Abiko, both of Japan

[73] Assignee: Toyo Umpanki Co., Ltd., Japan

[21] Appl. No.: 814,319

[22] Filed: Dec. 23, 1991

Related U.S. Application Data

[60] Continuation-in-part of Ser. No. 696,339, May 1, 1991, abandoned, which is a division of Ser. No. 461,528, Jan. 5, 1990, abandoned.

[30] Foreign Application Priority Data

Mar. 15, 1989 [JP] Japan ..... 1-64518

[51] Int. Cl.[5] ..... B66F 9/22

[52] U.S. Cl. ..... 414/719; 414/673; 212/196; 280/758

[58] Field of Search ..... 414/719, 673; 901/48; 267/138, 140.1 R; 188/379, 380; 280/758, 759; 212/195, 196

[56] References Cited

U.S. PATENT DOCUMENTS

| | | | |
|---|---|---|---|
| 2,887,071 | 5/1959 | Settles | 280/758 X |
| 3,334,886 | 8/1967 | Caunt | 188/379 X |
| 3,853,231 | 12/1974 | Luttrell | 414/719 |
| 4,093,259 | 6/1978 | Stedman | 280/758 X |
| 4,189,020 | 2/1980 | Abels et al. | 280/759 X |
| 4,658,970 | 4/1987 | Oliphant | 414/719 X |
| 4,674,638 | 6/1987 | Oliphant | 414/719 X |

FOREIGN PATENT DOCUMENTS

| | | | |
|---|---|---|---|
| 1288993 | 2/1969 | Fed. Rep. of Germany | 414/719 |
| 2448500 | 10/1980 | France | 414/719 |
| 60-3159 | 1/1985 | Japan . | |
| 63-265024 | 11/1988 | Japan . | |
| 0573442 | 9/1977 | U.S.S.R. | 414/719 |
| 0594041 | 2/1978 | U.S.S.R. | 414/719 |
| 0601492 | 4/1978 | U.S.S.R. | 188/379 |

*Primary Examiner*—Frank E. Werner
*Assistant Examiner*—James Eller
*Attorney, Agent, or Firm*—Barnes, Kisselle, Raisch, Choate, Whittemore & Hulbert

[57] ABSTRACT

The invention relates to cargo-handling vehicles and the like which comprise a handling device such as a bucket or a fork. A balancing device in equipped either at the front or the rear of the vehicle in such a way as to be rotatable on an axle which is horizontal and at right angles to the running direction of the vehicle, the balancing device comprising a balance weight coupled with a vehicle body by the axle, and an elastic body and a shock absorber provided between the balance weight and the vehicle body. Pitching phenomenon of a cargo-handling vehicle or the like can be automatically restrained in a responsive manner. It is possible to prevent the vehicle from overturning caused by an unexpected imbalance. The running stability can be improved and a comfortable ride accomplished.

3 Claims, 3 Drawing Sheets

VEHICLE EQUIPPED WITH BALANCING DEVICE

This is a continuation-in-part of copending application Ser. No. 07/696,339, filed on May 1, 1991, now abandoned, which is a division of Ser. No. 07/461,528, filed on Jan. 5, 1990, now abandoned.

FIELD OF THE INVENTION

This invention relates to various industrial vehicles such as cargo-handling vehicles having handling devices like a bucket or a fork at the front, and work vehicles like tractors.

BACKGROUND OF THE INVENTION

While cargo-handling vehicles and work vehicles mentioned above are running, their front wheels react to the unevenness of the road, causing the body of the vehicle to pitch and bound, thus requiring some control to slow down the running speed. The conventional countermeasures to this kind of problem are, as presented in the Japanese Laid Open Patent No. 63-265024, to equip a vibration-reducing accumulator to the hydraulic cylinder for operating the handling device by means of outside piping through a mode switching valve, and as shown in the Japanese Utility Model Publication No. 60-3159 to provide a balance weight at the rear of the vehicle body through a balancing cylinder. However, both of the conventional systems utilize a hydraulic system and accordingly have poor responsiveness, being unable to preferably control the pitching in spite of their complicated structures. Besides, the conventional systems require such controls as to operate the switching valve, thus having a disadvantage that the booms may be lowered by the switching.

DISCLOSURE OF THE INVENTION

The purpose of this invention is to provide a vehicle equipped with a balancing device which is responsive and requires no control.

In order to achieve this purpose, the present invention provides a vehicle equipped with a balancing device either at the front or the rear of the vehicle, wherein;

the balancing device is rotatable around an axle which is horizontal and at right angles to the running direction of the vehicle, the balancing device comprising;

a balance weight coupled with a vehicle body by means of the axle, and elastic body means and shock absorbing means provided between the balance weight and the vehicle body.

When the wheels of the vehicle react to the unevenness of a road while running, pitching of the main body may occur. For example, when such pitching occurs as to lower the cargo device mounted at the front of the vehicle, the main body of the vehicle bears a rotation moment to raise the rear portion of the vehicle with respect to the axis of the center of the inertia moment of the vehicle. Further, for example, when the front wheels run over any kind of obstacle, the main body of the vehicle bears a rotation moment to raise its front portion. In these cases, according to the present invention where a balancing device is so equipped either at the front or the rear of the vehicle as mentioned above, the balance weight of the balancing device reacts against the elastic body and shock absorber to rotate on the aforesaid axis in the opposite direction of the aforesaid rotation moment, consequently decreasing the rotation moment.

As a result, the pitching phenomenon is automatically restrained in a responsive manner with no control. Hence, it is possible to prevent the vehicle from overturning according to an unexpected disturbance of the balance and improve the running stability accomplishing a more comfortable ride.

PREFERRED EMBODIMENTS

Following are the description of the preferred embodiments of the present invention in accordance with FIGS. 1 to 5.

Figure 1:
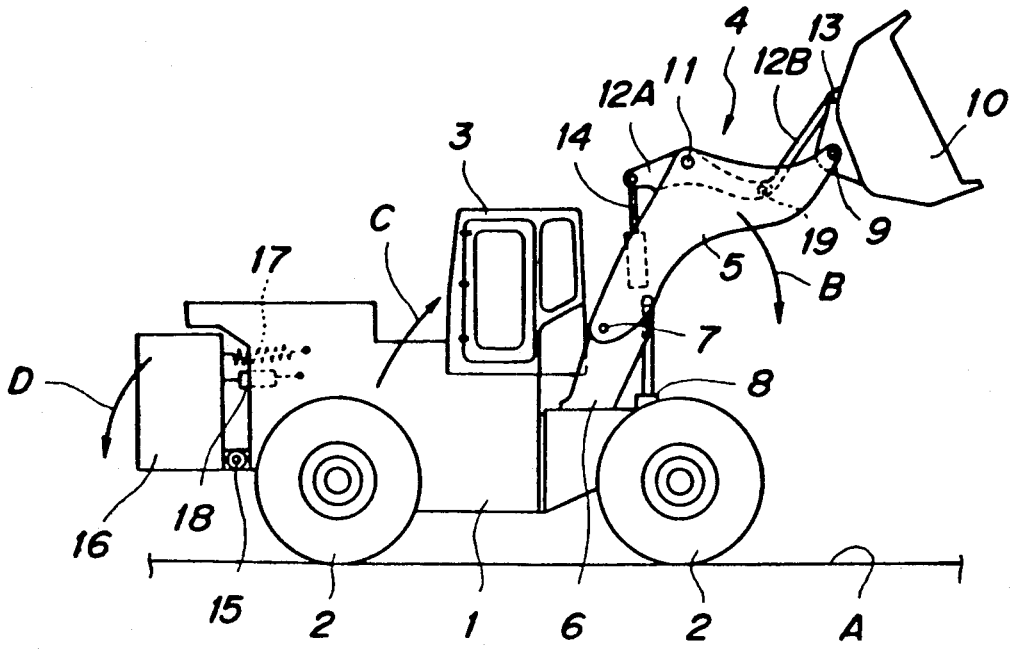
FIGS. 1 to 3 are the side view of the first to third embodiments of the present invention.

In FIG. 1, numeral 1 represents a main body of a vehicle having plural wheels 2, installed on which is a driver's cab 3 with a seat, levers and the like. At the front of vehicle body 1, a handling device 4 is mounted. To be more precise, at the front of the driver's cab 3, a pair of booms 5 are arranged, with their base ends connected to the brackets 6 protruding from the vehicle body 1 by means of a shaft 7, enabling the booms 5 swing up and down. Mounted between the vehicle body 1 and the booms 5 is a loading cylinder 8 which swingably drives the booms 5. A bucket 10 is attached between the free ends of the booms 5 by means of a lateral pin 9, and the free end of a first link 12A attached to the booms 5 by means of a pin 11 and the base end of a second link 12B are coupled by means of a pin 19. The free end of the second link 12B and the bucket 10 are linked by means of a pin 13. A cylinder 14 is mounted between the base end of the first link 12A and the booms 5 so as to make the said bucket 10 rotate around the lateral pin 9. A balance weight 16 is swingably attached to vehicle body 1 by means of a lateral axle 15 which is horizontal and at right angles to the running direction of the vehicle. A tensile spring 17 (an example of elastic body means) and a shock absorber 18 are provided between the vehicle body 1 and the balance weight 16. The number of tensile springs 17 and shock absorbers 18 are properly determined depending on the weight of the balance weight 16 and other relavant factors.

When the cargo-handling vehicle with its unloaded handling device 4 raised up is driven, if the wheels 2 react to the uneven surface of the road, the vehicle body 1 is caused to pitch. When such pitching as to lower the booms 5 (arrow B) occurs while the vehicle runs, the vehicle body 1 bears near its front wheels a rotation moment C which will raise the rear portion of the vehicle body 1. As a result, the balance weight 16 bears a rotation moment D which is produced with respect to the lateral axle 15 against the tensile spring 17 and the shock absorber 18 in the opposite direction of the rotation moment C. Both rotation moments C, D counterbalance each other so as to decrease rotation moment C, thus the pitching motion abates. When the vehicle body 1 bounds upward (parallel movement), the balance weight 16, due to the inertia moment, reacts to remain in the orignal position, so that the vehicle body 1 is forced downward to decrease its bound.

Figure 2:
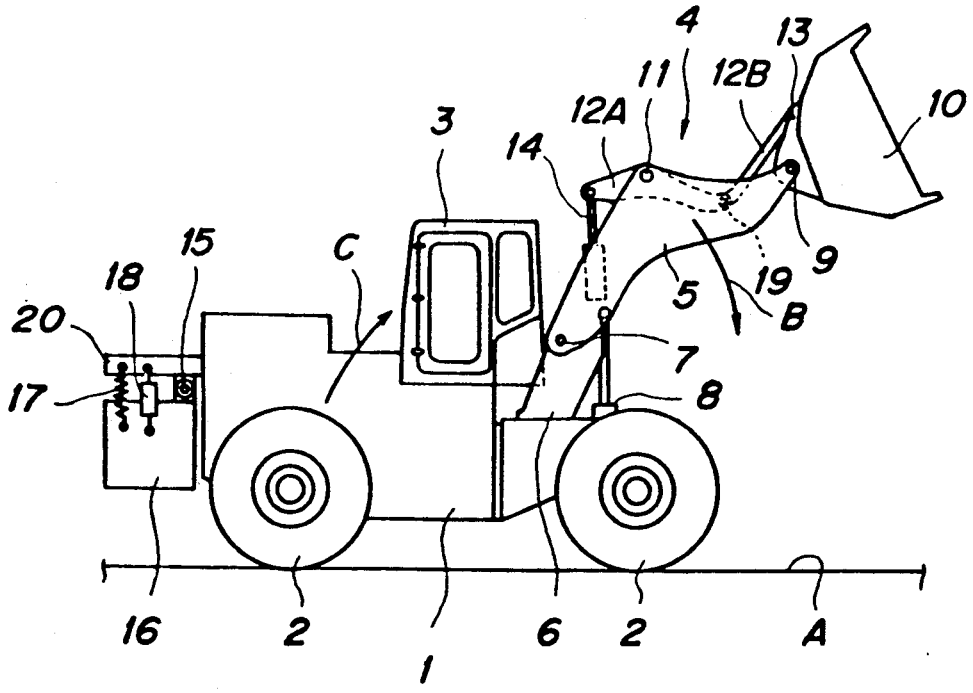

FIG. 2 represents the second embodiment where a balance weight 16 is arranged to be swingable at a position beneath a frame 20 by means of a lateral axle 15 which is horizontal and at right angles to the running direction. A tensile spring 17 and a shock absorber 18 are provided between the balance weight 16 and the frame 20.

When the frame 20 is to be raised in the direction of a rotation moment C, the balance weight 16 bears a rotation moment around the lateral axle 15 in the opposite direction to the rotation moment C against the tensile spring 17 and the shock absorber 18. Thus the rotation moment C can be decreased and the pitching phenomenon restrained.

Figure 3:
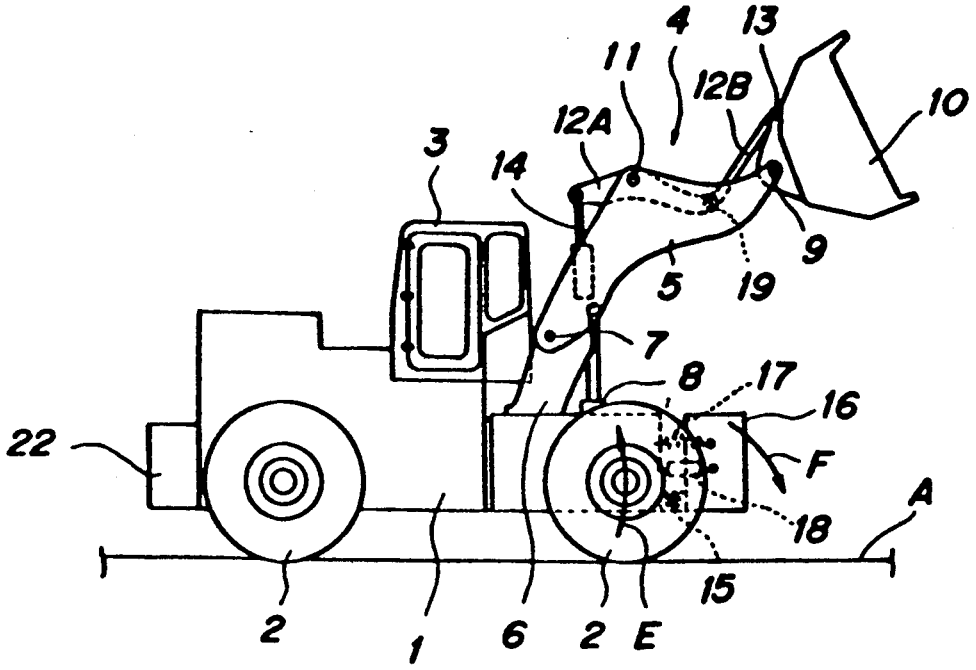

FIG. 3 represents the third embodiment of the present invention where a balance weight 16 is provided at the front of a vehicle body 1 by means of a lateral axle 15 which is horizontal and at right angles to the running direction of the vehicle. A tensile spring 17 and a shock absorber 18 are provided between the vehicle body 1 and the balance weight 16. Another balance weight 22 is added at the rear of the vehicle body 1.

When front wheels run over any kind of obstacle and such rotation moment E is produced as to raise the front portion of the vehicle body 1, the balance weight 16 bears a rotation moment F around the lateral axle 15 in the opposite direction of the rotation moment E against the tensile spring 17 and the shock absorber 18. Both rotation moments E and F counterbalance each other to decrease the rotation moment E.

Arranged at the rear of the vehicle body 1 is a balance weight 22 which is attached to the vehicle body 1 rigidly.

Figure 4:
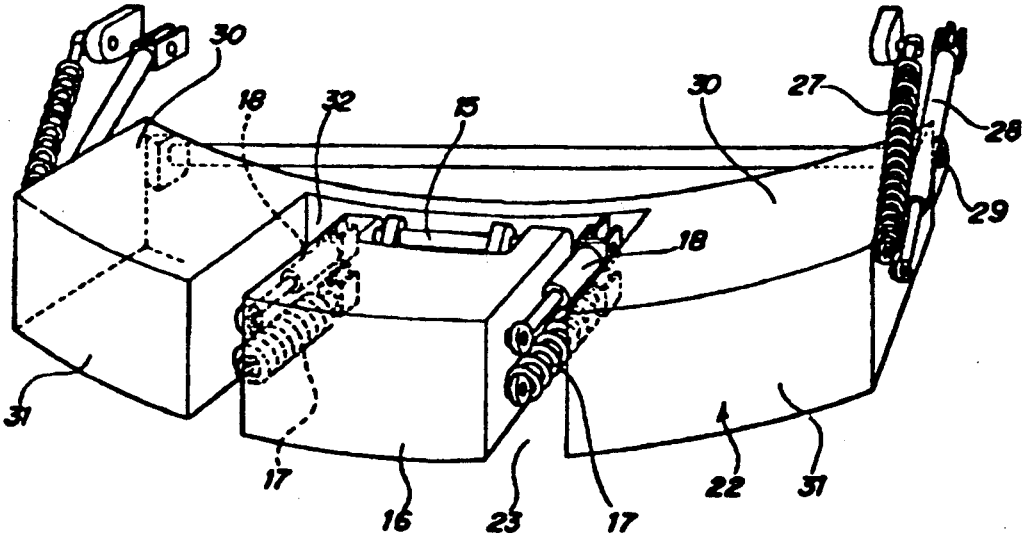
FIG. 4 is the perspective view of the main part of the divided weight system in the fourth embodiment.

FIG. 4 shows another embodiment of the present invention. This embodiment is based on a concept that different modes of oscillation generated by different loads or different force inputs on the vehicle should be attenuated by means of different balance weights, i.e., a first balance weight 22 and a second balance weight 16.

The first balance weight 22 having a central recess 23 is pivotally connected to the rear end of the vehicle body 1, and the balance weight 16 is placed in the recess 23. The balance weight 16 is attached to the balance weight 22 by means of a lateral axle 15 the longitudinal axis of which is horizontal and rectangular to the running direction of the vehicle so as to enable the balance weight 16 to swing around the longitudinal axis of axle 15. Tensile springs 17 and shock absorbers 18 are provided between the balance weights 16 and 22.

Means for yieldingly biasing the first balance weight 22 includes springs 27 and dashpots 28 connected between the vehicle body 1 and the first balance weight 22. The spring constant of the springs 27 and the attenuation coefficient of the dashpots 28 are larger than the spring constant of the springs 17 and the attenuation coefficient of the dashpots 18. Preferably the horizontal axle 15 extends parallel with a horizontal axle 29 about the longitudinal axis of which the first balance weight 22 is adapted for pivotal movement.

The central recess 23 opens through the upper surface 30, bottom surface and rear surface 31 of the first balance weight 22, and has an inner surface 32 which is parallel with the rear surface 31 of the first balance weight 22. The second balance weight 16 is pivotally connected to this inner surface 32 for pivotal movement about the longitudinal axis of horizontal axle 15.

Although only a cargo-handling vehicle having a bucket 10 at the front is shown in each of the aforesaid embodiments, work vehicles like tractors can be represented in these embodiments. Moreover, the handling device can be replaced by a fork device.

Figure 5:
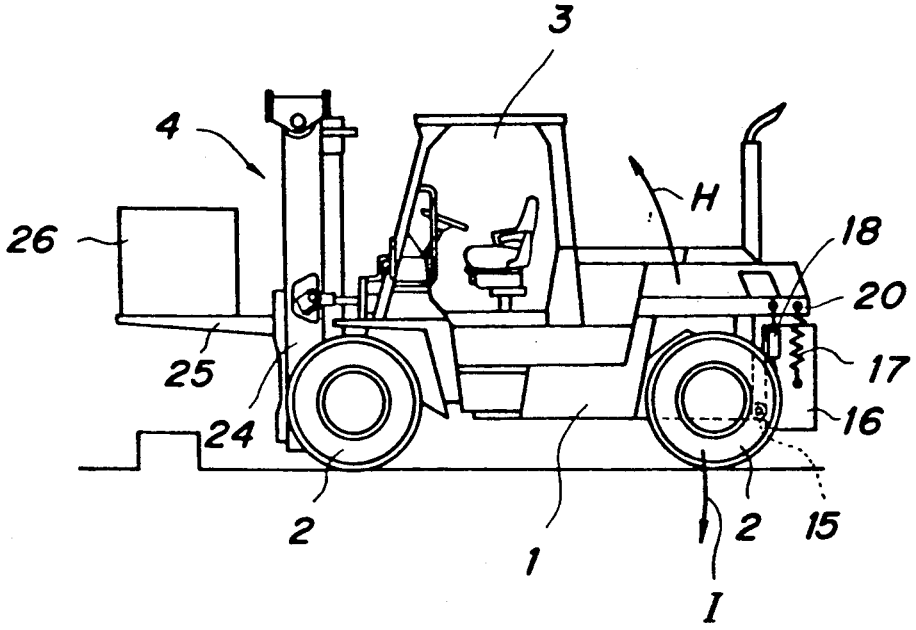
FIG. 5 is the side view of the fifth embodiment.

In this connection, FIG. 5 shows the fifth embodiment of the present invention in respect of a fork lift. A handling device 4 mounted at the front of a vehicle body 1 is consisted of a mast 24 and a fork 25. This kind of fork lift is subject to pitching while running with load 26, since the center of gravity moves toward the front of the vehicle according to the weight of the load 26. If the vehicle body 1 is provided with a balance weight 16 being able to swing around a lateral axle 15 the axis of which is horizontal and at right angles to the running direction of the vehicle, pitching can be decreased. If the front wheels run over some obstruction and later fall down therefrom, the rear wheels would spring up in the direction of the arrow H, so that a shock absorber 18 moves toward the direction of the arrow I and absorbs the swing motion. In addition to this balancing effect while running, a similar behavior takes place even when load 26 is rapidly lowered by misoperation and then stopped. This is a great advantage to safety.

Tensile springs (coil springs) shown in the aforesaid embodiments as an elastic body can be replaced by compression springs, leaf springs or torsion springs.

What is claimed is:

1. A vehicular system for loading, transporting and unloading purposes comprising:

a vehicle body having a forward end and a rear end;

ground-engaging wheels supporting said vehicle body;

a load-handling means pivotally connected to the forward end of said vehicle body for pivotal movement about a horizontal axis between a raised position and a lowered position;

a first balance weight having an upper surface, a bottom surface and a rear surface and pivotally connected to said rear end of said vehicle body for pivotal movement about a horizontal axis extending transversely of said vehicle body;

first biasing means for yieldingly biasing said first balance weight, said first biasing means including springs and dashpots spaced transversely of said rear end of said vehicle body and connected between said vehicle body and said first balance weight and operable to reduce the vibration of said first balance weight relative to said vehicle body as said vehicular system moves on the ground;

a second balance weight pivotally connected to said first balance weight; and second biasing means for yieldingly biasing said second balance weight, said second biasing means including springs and dashpots spaced transversely and connected between said first balance weight and said second balance weight and operable to reduce the vibration of said second balance weight relative to said first balance weight as said vehicular system moves on the ground.

2. A vehicular system according to claim 1, wherein said first balance weight is provided with a central recess opening through said upper, bottom and rear surfaces of said first balance weight, and said second balance weight is disposed in said central recess.

3. A vehicular system according to claim 2, wherein said central recess has an inner surface parallel with said rear surface of said first balance weight, and said second balance weight is pivotally connected to said inner surface for pivotal movement about a horizontal axis extending parallel with said horizontal axis about which said first balance weight is adapted for pivotal movement.

* * * * *